United States Patent [19]

Roosa

[11] Patent Number: 5,012,929

[45] Date of Patent: May 7, 1991

[54] TWIN TRAY CONTAINER

[75] Inventor: Paul D. Roosa, Saugerties, N.Y.

[73] Assignee: International Paper Company, Purchase, N.Y.

[21] Appl. No.: 557,821

[22] Filed: Jul. 26, 1990

[51] Int. Cl.[5] ..... B65D 5/48; B65D 5/54

[52] U.S. Cl. ..... 206/602; 229/120.03; 229/170.08

[58] Field of Search ..... 206/602, 611, 614; 229/120.03, 120.04, 120.08

[56] References Cited

U.S. PATENT DOCUMENTS

| | | | |
|---|---|---|---|
| 3,082,929 | 3/1963 | Aquino et al. | 206/602 |
| 3,341,103 | 9/1967 | May | 206/602 |
| 3,394.869 | 7/1968 | Fontana et al. | 229/120.03 |
| 4,826,016 | 5/1989 | Foster | 206/602 |
| 4,871,067 | 10/1989 | Valenti | 206/602 |
| 4,919,269 | 4/1990 | Wright et al. | 206/602 |

FOREIGN PATENT DOCUMENTS

| | | | |
|---|---|---|---|
| 753118 | 2/1967 | Canada | 229/120.03 |
| 298668 | 8/1965 | Netherlands | 229/120.04 |
| 2164634 | 3/1986 | United Kingdom | 206/602 |

*Primary Examiner*—Gary E. Elkins
*Attorney, Agent, or Firm*—Michael J. Doyle

[57] ABSTRACT

A pair of relatively small spaced apart identical tray type containers for packaging products such as food are formed from a one-piece blank arranged so that, when completed with the contents enclosed, the containers can only be opened by ripping apart integral tamper-proof tear-away portions, not by just separating the flaps or panels.

In some embodiments tear strips are provided across the middle panel portion to allow easy severance of the containers from each other.

10 Claims, 6 Drawing Sheets

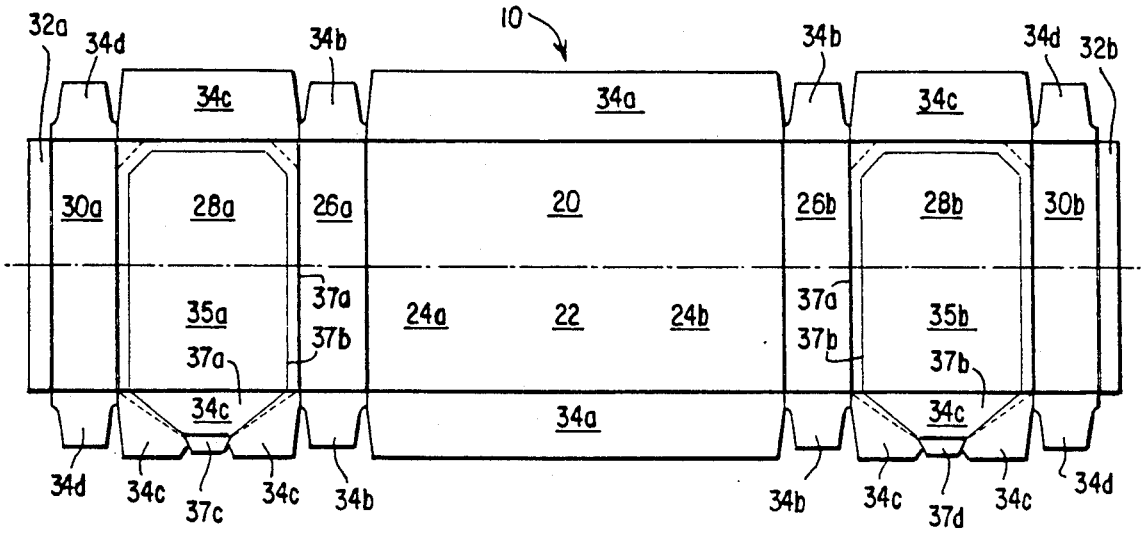
FIG. 1
FIG. 2
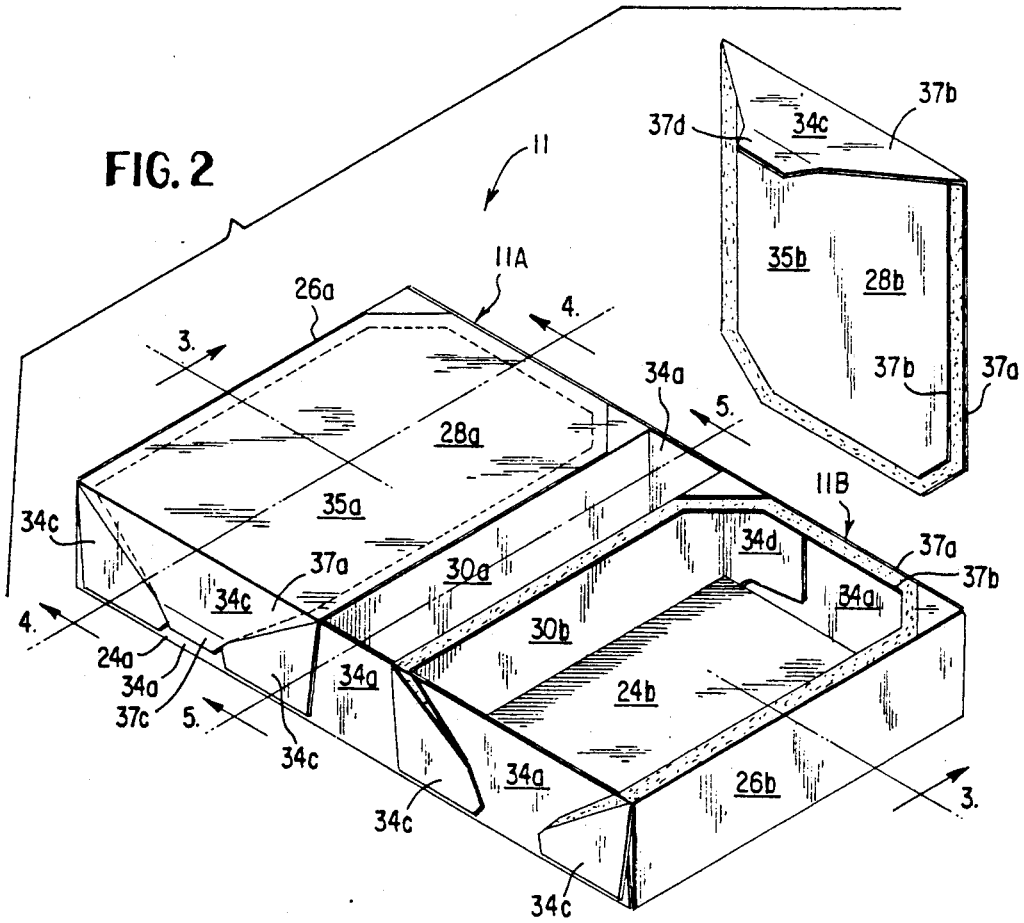

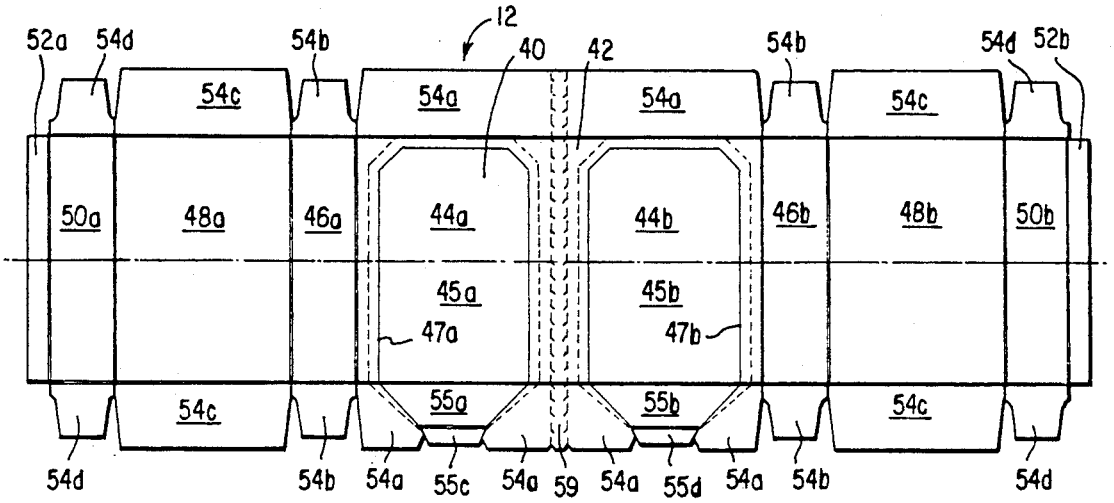
FIG. 6
FIG. 7
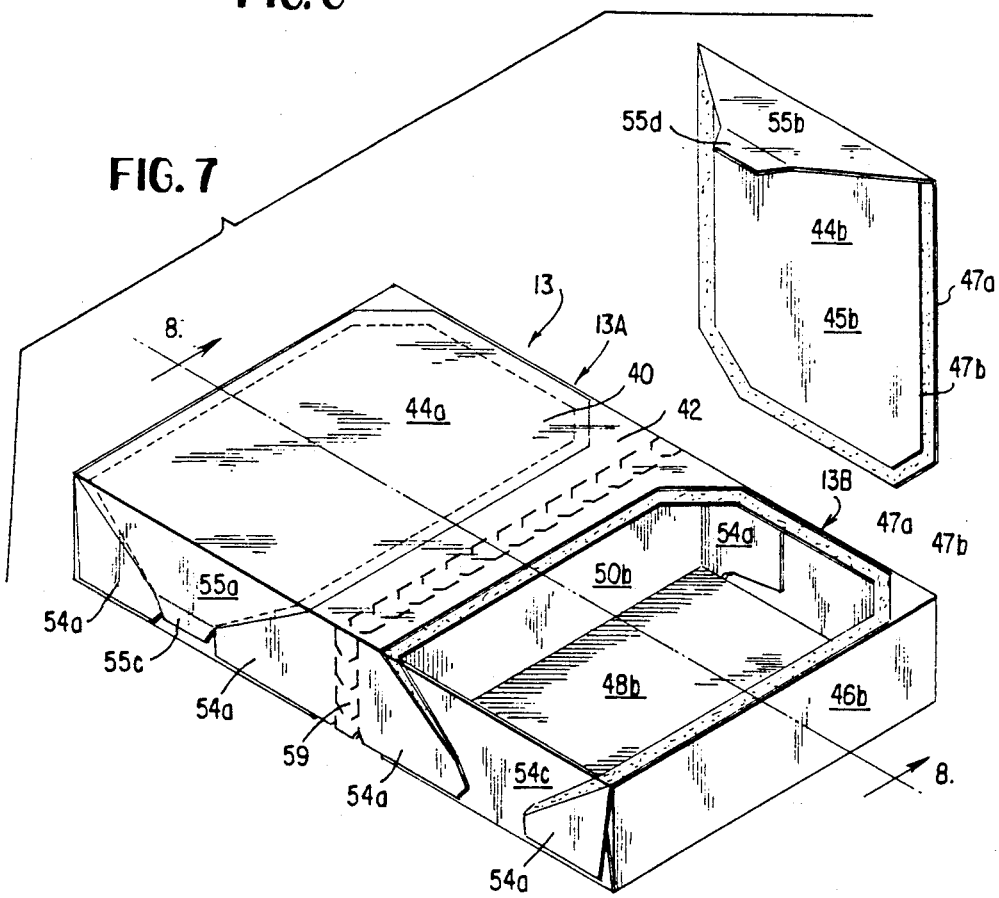

TWIN TRAY CONTAINER

BACKGROUND OF THE INVENTION

In the food and other consumer products industries, a need and therefore a market has been established for a twin-tray type small container for packaging food or food products, either as two separate portions in a single double-container structure or two different products such as a meat portion and a vegetable portion in the same two-container structure.

As an example, a double portion of the same product can be packaged in the twin trays which can then be separated, one opened for immediate use and the other put away for subsequent use or for use by two different people. As another example, a meat product can be put in one and a vegetable product in the other. Such a structure can be adapted for microwave use by the addition of microwave susceptor material for preparing related but separate food substances.

To be more acceptable to the customer, the product has to be user friendly, that is, easily handled and opened and at the same time tamper proof so that if one or both of the containers are opened prior to purchase by the end customer this fact will be readily apparent. This requires a seal of some sort which will remain intact until final use.

Such containers are supplied by the original manufacturer in flat, unerected, tubular form for erection by the customer's conventional forming, filling and sealing equipment. To keep the price down for the benefit of the original manufacturer, the customer for the unerected flat partially completed blanks who will erect the containers, fill them, and sell them and also the final customer of the food product, it is desirable to provide a container which may be formed from a one-piece flat blank which can be processed on such conventional packaging machinery and which will have an economy of material and as few parts as possible to provide the necessary features.

If such a twin arrangement is provided, particularly in substantially separated form, it is desirable to contemplate the inclusion of a relatively large panel portion which can be used as a billboard for printed and graphic advertising and informational intelligence.

It is the broad object of this invention to incorporate the above described desirable features in a one-part blank and also a twin-type container arrangement formed from the blank in a choice of embodiments and with an economy of material and container forming, filling and sealing process.

SUMMARY OF THE INVENTION

The invention includes a one part paperboard blank for forming spaced-apart identical tray type containers for packaging products, primarily food, in which a relatively large central panel portion serves not only to form major panels in erected containers, either the tops or the bottoms depending upon the embodiments, but also a bridge across the spaced-apart containers and in which additional panel forming portions and glue tabs extend successively and foldably outwardly from the ends of the central panel portion and in which the glue tabs are brought around and glued to the central panel portion, thus forming the top, bottoms and sides of the containers. End panel portions are foldably attached to the major and minor panel portions to provide end panels for the containers.

Tear-away portions are provided which are integrally preformed in a pair of major top panels or else in end panel portions of the blank thus providing easy access to the contents of each of the containers.

One form of such tear-away portion is defined and pre-formed by the reverse cut construction as known in the art to facilitate ripping apart of the material of the panel portion.

Another form is the so-called H-pattern of perforations to provide lines of weakness on both sides of the tear-away portion for easier ripping apart of the panel material. The important feature is the tearing apart of the material of a panel and not just separtion of one panel from another in the structure of the completed container. Thus any previous opening and unsealing is readily discernible so as to provide the tamper-proof feature.

In a first embodiment of the invention, a relatively large central panel portion of the blank bridges the containers across their bottoms and also forms their bottoms, while the tear-away portions are defined and provided in the other and outer major panel portions by the reverse cut construction.

In a second embodiment the relatively large tear-away portions are provided in the central panel portion of the blank which in this form provides the tops of the containers.

In the third embodiment the tear-away portions are provided between the double lines of H-pattern perforations which extend along the length of the end panel portions.

DESCRIPTION OF THE DRAWINGS

FIG. 1 is a layout or plan view of one embodiment of a one-piece blank of the invention showing removable tear-away portions on top forming outer major panel portions.

FIG. 2 is a partially exploded perspective view of twin containers formed from the blank of FIG. 1, showing one of the tear-away portions removed from the top of one of the containers.

FIG. 6 is a layout or plan view of a second embodiment of a one-piece blank of the invention showing removable tear-away portions on the top forming large central panel portion.

FIG. 7 is a partially exploded perspective view of twin containers formed from the blank of FIG. 6 and showing one of the tear-away portions removed from the top of on of the containers.

DETAILED DESCRIPTION OF THE INVENTION

A first embodiment of the invention is shown in FIGS. 1-5 inclusive in which FIG. 1 shows the blank indicated at 10 and FIG. 2 shows the container structure erected from the blank indicated at 11.

A second embodiment is shown in FIGS. 6-9 inclusive in which FIG. 6 shows the blank indicated at 12 and FIG. 7 shows the container structure indicated at 13 made from the blank 12.

A third embodiment is illustrated in FIGS. 10-14 inclusive in which the blank is indicated at 14 and the container made from the blank is indicated at 15.

Figure 3:
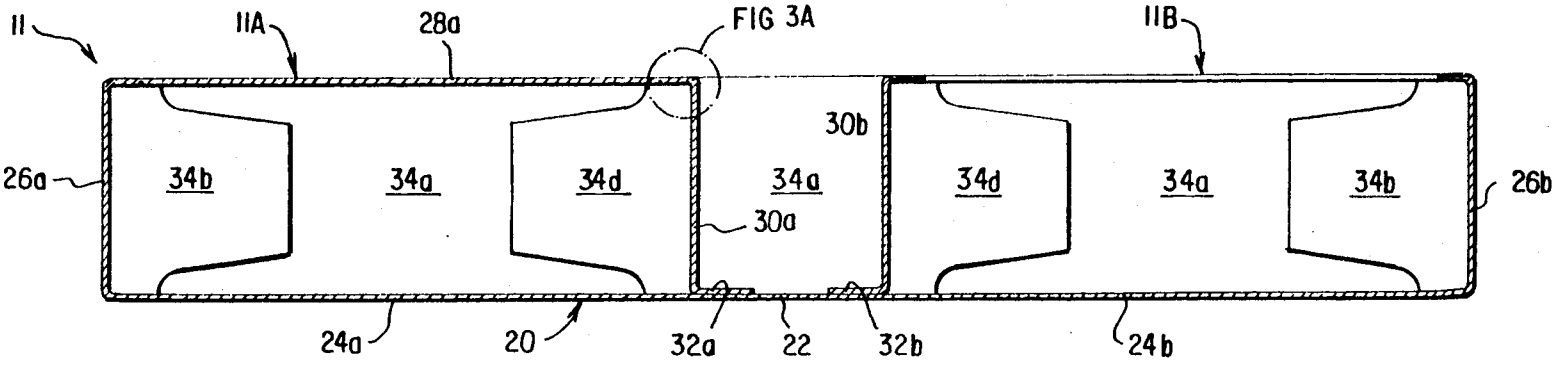
FIG. 3 is a section view of the containers of FIG. 2 taken along line 3—3 of FIG. 2.
Figure 4:
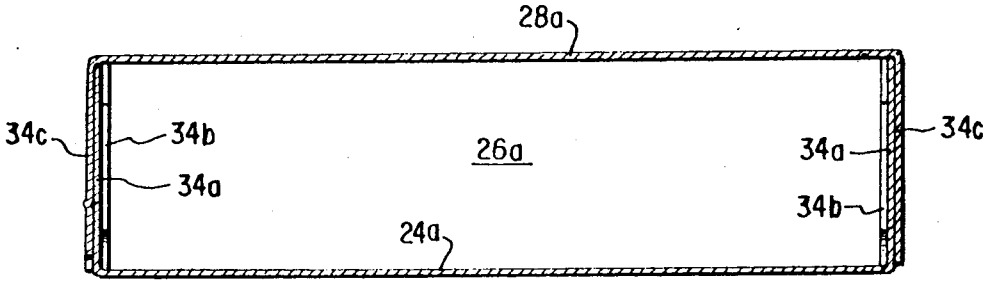
FIG. 4 is a section view of one of the containers of FIG. 2 taken along line 4—4 of FIG. 2.

The blank 10 in FIG. 1 has a relatively large central panel portion 20 for forming a bridge 22 as seen in FIG. 3 across a substantial space between the two containers 11A and 11B of the twin-tray type structure 11. In this embodiment the panel portion 20 also forms the bottoms 24*a* and 24*b* of the containers 11A and 11B as seen in FIGS. 3 and 4.

Inner minor panel portions 26*a* and 26*b* are foldably attached to the ends of the central panel portion 20 for forming the outer side edge panels of the two containers 11A and 11B as seen in FIG. 3. Outer major panel portions 28*a* and 28*b* are foldably attached to the outer edges of the minor panel portions 26*a* and 26*b* for forming the other major panels, in this case the tops 28*a* and 28*b* of the erected containers of FIG. 2 as best seen in FIG. 3.

Outer minor panel portions 30*a* and 30*b* are foldably attached to the outer edges of the outer major panel portions 28*a* and 28*b* forming the other and inner side edge panels of the containers as seen in FIGS. 2 and 3.

Glue tabs 32*a* and 32*b* are foldably attached to the outer edges of the outer minor panel portions 30*a* and 30*b* to secure the blank 10 to itself as seen in FIG. 3 so that it can be shipped in flat form before erecting and filling.

End panel portions 34*a*, 34*b*, 34*c*, and 34*d* are foldably attached respectively to the central panel portion 20, the inner minor panel portions 26*a* and 26*b*, the outer major panel portions 28*a* and 28*b*, and the outer minor panel portions 30*a* and 30*b* to provide end panels for the container 11 as seen in FIGS. 2 and 4.

The top panel portions 28*a* and 28*b* have tear-away portions 35*a* and 35*b* integrally formed with and occupying substantial areas of them. They are defined and pre-formed by reverse cut construction cuts 37*a* and 37*b*, seen most clearly in FIG. 3*a* enlarged from FIG. 3, to facilitate ripping apart the tear-away portions 35*a* and 35*b* from the remaining parts of the tops 28*a* and 28*b*.

The tear-away portions 35*a* and 35*b* terminate in tapered portions 37*a* and 37*b* which themselves terminate in lift tabs 37*c* and 37*d*.

When the carton structure 11 is assembled into the form seen in FIG. 2, the end panels 34*a*, 34*b*, 34*c*, and 34*d* are glued to each other except that no glue is applied between the portions 36*a*, 37*b*, 37*c* and 37*d* of the tear-away panels 35*a* and 35*b* and the end panels 34*a* against which they abut. Thus, when the lift tabs 37*c* and 37*d* are pulled away by the ultimate consumer, the unglued portions 37*a* and 37*b* of the tear-away portions 35*a* and 35*b* readily come away from the end panels for easy tearing away by ripping along the reverse cuts 37*a* and 37*b* as seen in FIG. 2.

In the second embodiment the blank indicated at 12 in FIG. 6 is eventually formed into the container structure indicated at 13 in FIG. 7, comprising individual containers 13A and 13B.

Figure 8:
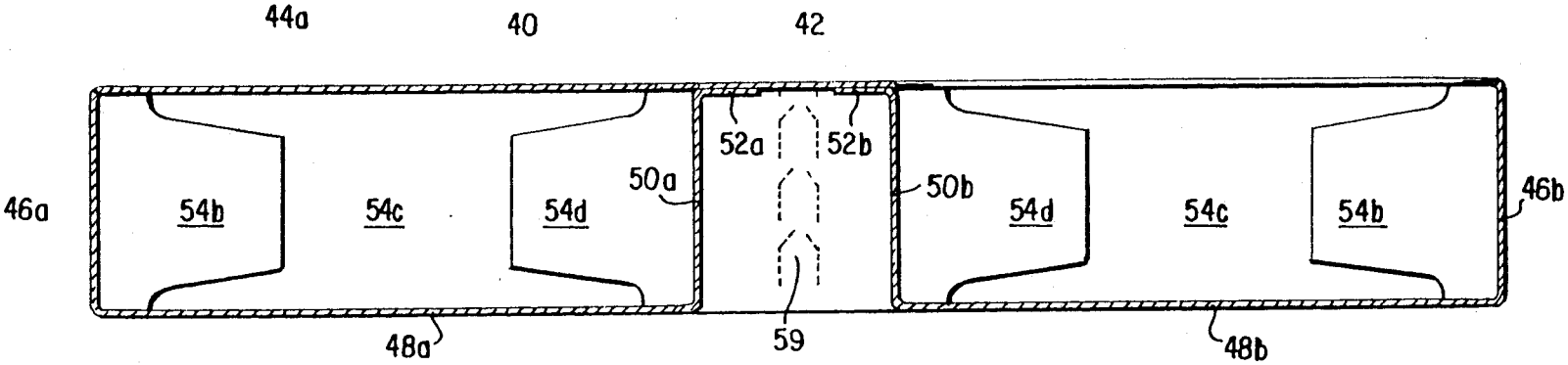
FIG. 8 is a section view of the containers of FIG. 7 taken along the line 8—8 of FIG. 7.

In this embodiment the blank 12 is essentially the same as the blank 10 of the first embodiment except that, as best seen in FIGS. 6 and 7, the central panel portion 40 provides the tops 44*a* and 44*b* of the two containers 13A and 13B and a top bridge portion 42 across a substantial space between the containers as best seen in FIG. 8, these being top forming major panel portions 44*a* and 44*b* of the blank 12.

Inner minor panel portions 46*a* and 46*b* are foldably attached to the ends of the central panel portion 40 for forming outer edge panels of the containers 13A and 13B as best seen in FIG. 8. Outer major panel portions 48*a* and 48*b* are foldably attached to the outer edges of the minor panel portions 46*a* and 46*b* for forming the other and bottom major panels of the containers 13A and 13B. Outer minor panel portions 50*a* and 50*b* are foldably attached to the outer edges of the outer major panel portions 48*a* and 48*b* for forming the other and inner side edge panels 50*a* and 50*b* of the two containers 13A and 13B, as best seen in FIG. 8.

Glue tabs 52*a* and 52*b* are foldably attached to the outer edges of the outer minor panel portions 50*a* and 50*b* and are glued under the central panel portion 40, as best seen in FIG. 8, so the structure can be shipped in flat condition.

Figure 9:
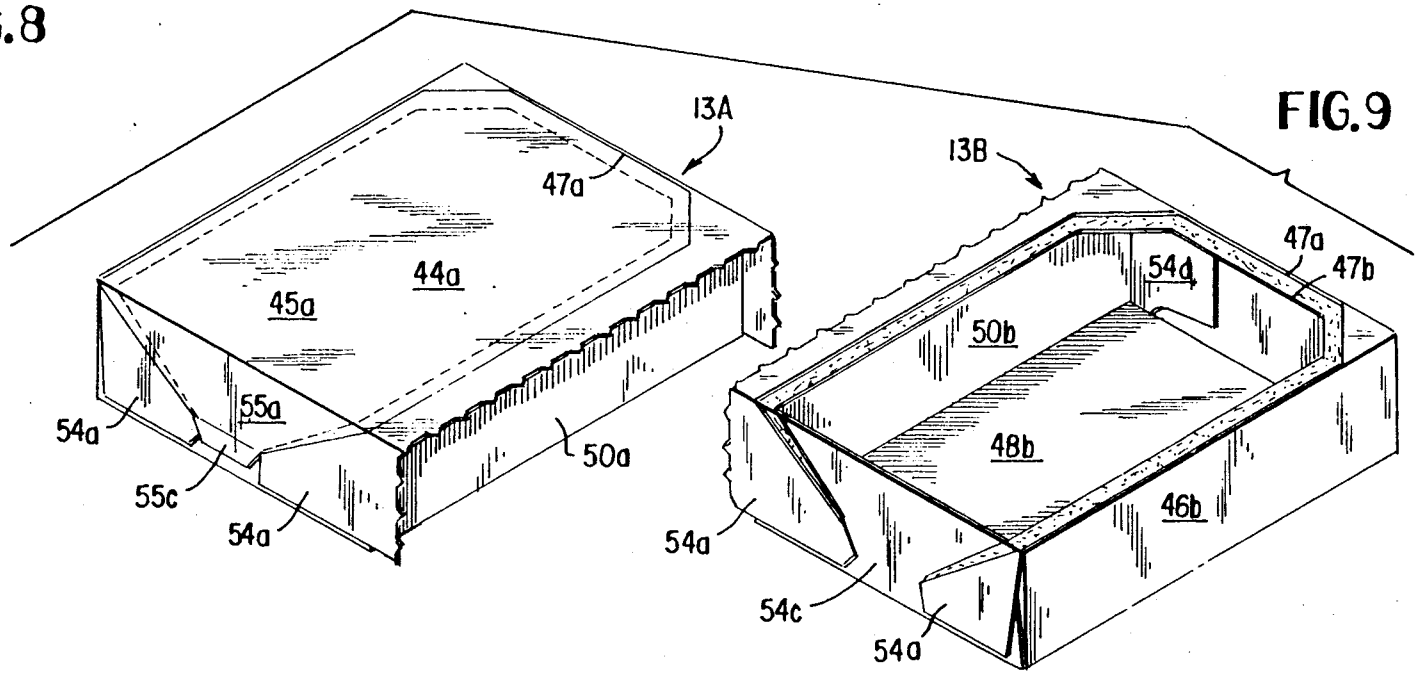
FIG. 9 is a perspective view of the containers of FIG. 7 showing them separated from each other and with the tear-away portion removed from one of them.

End panel portions 54*a*, 54*b*, 54*c*, and 54*d* are foldably attached to the major and minor panel portions to provide end panels for the containers 13A and 13B, as seen in FIGS. 7 and 9.

Figure 3A:
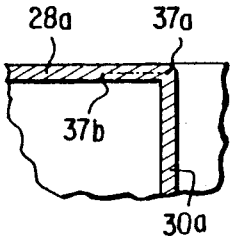
FIG. 3*a* is an expanded partial view as indicated in FIG. 3 showing the reverse cut construction to facilitate ripping apart of the tear-away portion as illustrated in FIG. 2.
Figure 5:
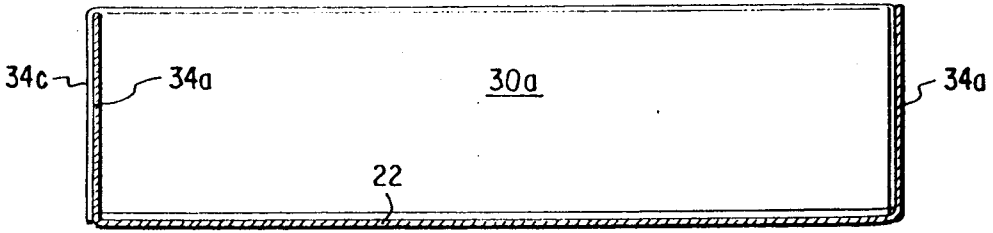
FIG. 5 is a section view of the containers of FIG. 2 taken along the line 5—5 of FIG. 2.

In this embodiment the central panel portion 40 has a pair of tear-away portions 45*a* and 45*b* each integrally formed with and occupying a substantial area of the top panel portions 44*a* and 44*b*. They are defined and preformed by reverse cut construction cuts 47*a* and 47*b* to facilitate ripping apart from the tops 44*a* and 44*b*. As in the first embodiment, the details of this reverse cut arrangement are shown in FIG. 3*a*.

The blank 12 has a tear strip 59 across the middle of the central panel portion 40 and the end panel portions 54*a* on both sides, as seen in FIGS. 6 and 7. This is formed by a double line of so-called H-pattern perforations forming lines of weakness so that it may be easily removed to separate the two halves of the structure 13 into two separate cartons.

The tear-away portions 45*a* and 45*b* terminate in tapered portions 55*a* and 55*b* which themselves terminate in lift-tabs 55*c* and 55*d*.

When the carton structure 13 is assembled into the form seen in FIGS. 7 and 9, the end panels 54*a*, 54*b*, 54*c*, and 54*d* are glued to each other except that no glue is applied between the portions 55*a*, 55*b*, 55*c*, and 55*d* of the tear-away panels 45*a*, 45*b* and the end panels 54*c* against which they abut. Thus, when the lift tabs 55*c* and 55*d* are pulled away by the ultimate consumer, the unglued portions 55*a* and 55*b* of the tear-away portions 45*a* and 45*b*, readily come away from the end panels 54*c* for easy tearing away by ripping along the reverse cuts 47*a* and 47*b* as seen in FIG. 7.

In the third embodiment of the blank 14 and the erected container structure 15 the corresponding body parts are essentially the same as in the first two embodiments except for the tear-away portions.

Figure 10:
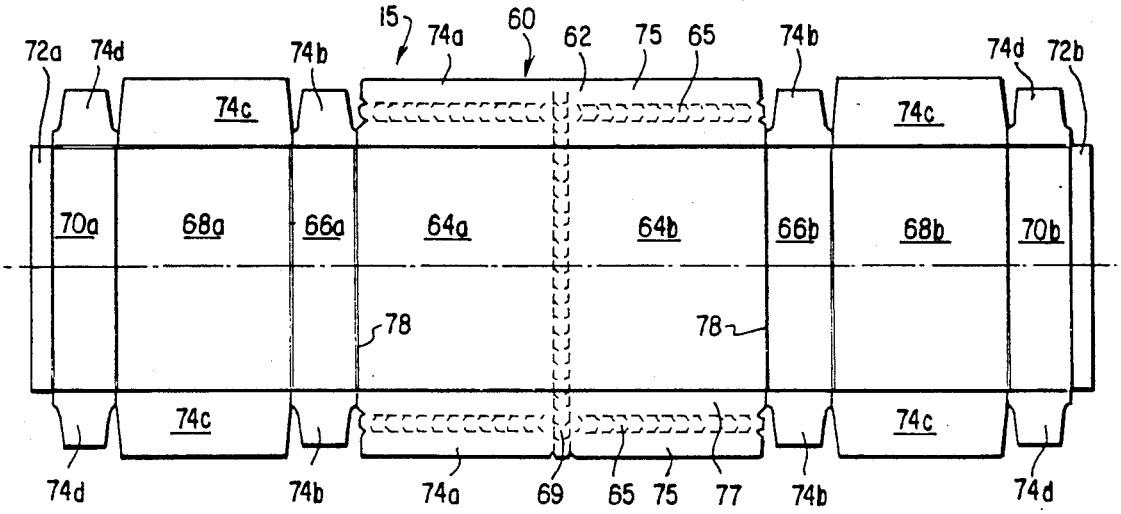
FIG. 10 is a layout or plan view of a third embodiment of a one-piece blank of the invention showing removable tear-away portions for opening the ends of the containers located along the end panel portions of the central panel portion as well as a transverse tear strip for separating the containers.
Figure 12:
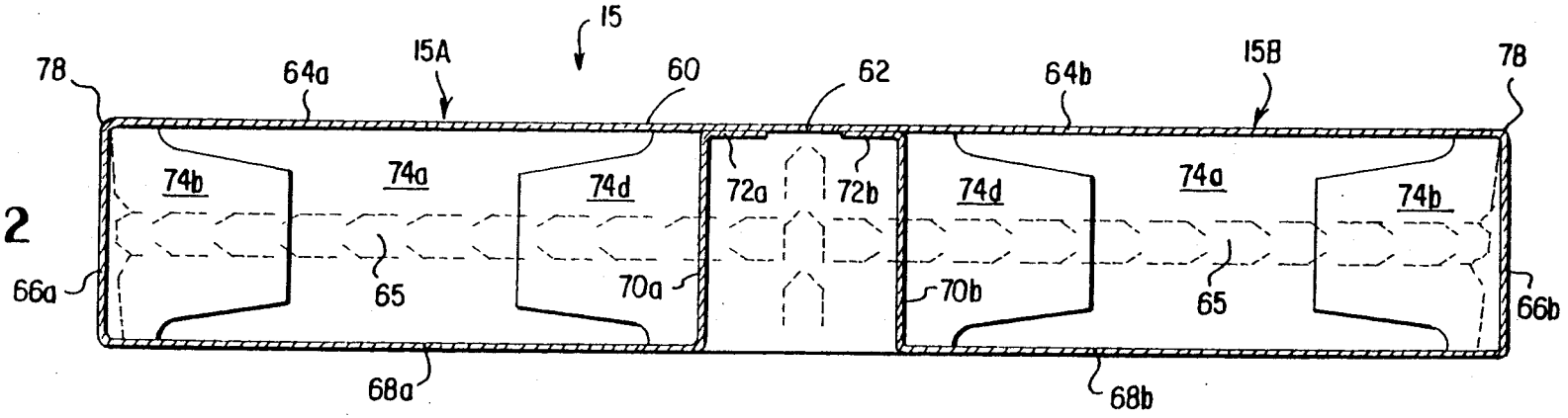
FIG. 12 is a section view of the containers of FIG. 11 taken along the line 12—12 of FIG. 11.
Figure 14:
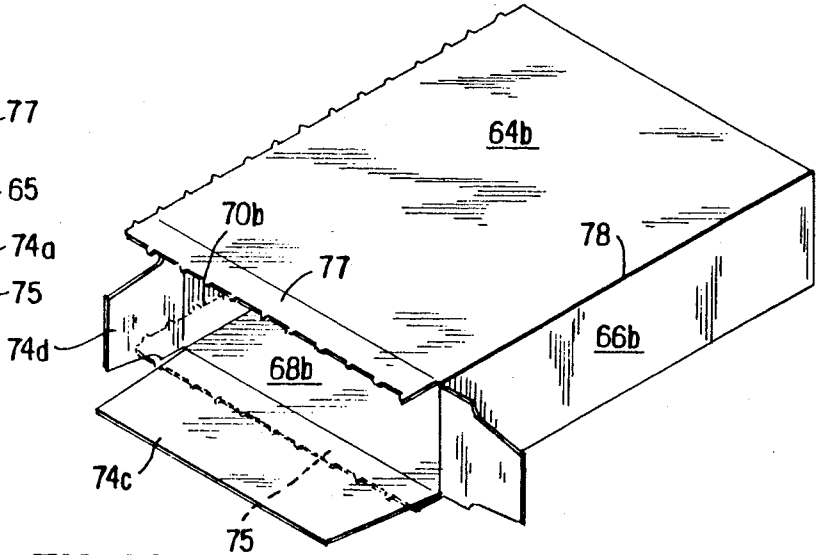
FIG. 14 is a perspective view of one of the containers of FIG. 11 after it has been removed from the other and showing one end opened for access to the contents after removal of the tear-away portion which had kept it closed.
Figure 13:
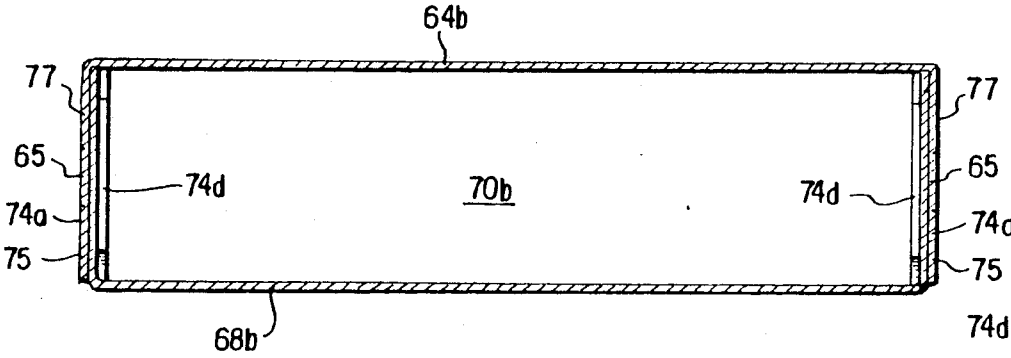
FIG. 13 is a section view of one of the containers of FIG. 11 taken along the line 13—13 of FIG. 11.

As seen in FIG. 10, the blank 14 has a central panel portion 60, a central bridge portion 62, and top portions 64*a* and 64*b*. Inner minor panel portions 66*a* and 66*b* for forming the outer side edges of the containers 15A and 15B are foldably attached to the ends of the central panel portion 60. Outer major panel portions 68*a* and 68*b* are foldably attached to the outer edges of the minor panel portions 66*a* and 66*b* for forming the other and bottom major panels of the two containers 15A and 15B as seen in FIG. 12.

Outer minor panel portions 70*a* and 70*b* are foldably attached to the outer edges of the panel portions 68*a* and 68*b* for forming the other and inner side edge panels of the same containers. Glue tabs are foldably attached to the outer edges of the outer minor panels portions 70*a* and 70*b* for securing the blank 14 into the double tubular condition seen in erected form in FIG. 12.

All of the panel portions 60, 66*a*, 66*b*, 68*a* and 68*b* and 70A and 70B have end panel portions 74*a*, 74*b*, 74*c* and 74*d* respectively foldably attached to them to provide the end panels for the containers 15A and 15B.

Figure 11:
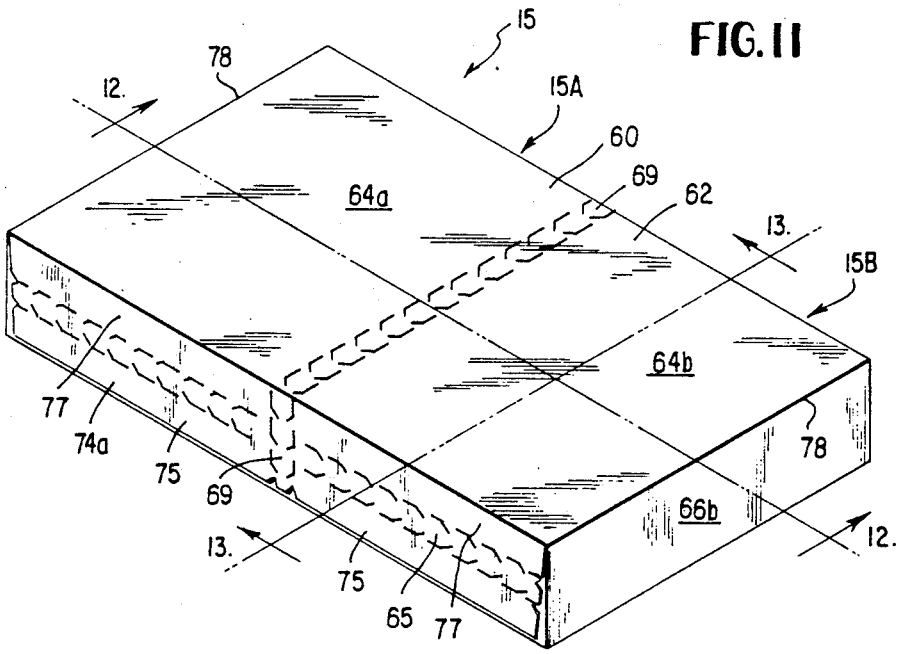
FIG. 11 is a perspective view of twin containers formed from the blank of FIG. 10.

The tear-away portions in this embodiment consists of tear strips 65 formed by parallel lines of H-pattern perforations running lengthwise of the end panels 74*a* as seen in FIGS. 10 and 11.

In this case when the end panels of the container structure are glued together, the upper or inner portions 77 of the panels 74*a* and also the tear strips 65 are left unglued, and only the outer or lower portions 75 are glued to secure the box closed. Therefore when the glue strip 65 is removed on both sides and the center strip 69 separating the containers is also removed, either the top 64*a* or 64*b* or both will be free to be raised pivotally around its outer hinge line 78.

Thus the invention presents a container structure of the twin-tray type for food products and other materials which has a tamper proof feature in which some of the material of the container must be ripped apart and torn away from itself to open the container to get at the contents so that this is not just a matter of separating one panel from another as in conventional containers in the art. This cannot be accomplished without revealing that it has been done with the result that the closure is tamper proof.

What is claimed is:

1. A one-part paperboard blank for forming a tamper proof twin tray type structure comprising two separate containers suitable for packaging food, said blank including successively:

(a) a relatively large central panel portion for forming a bridge across a substantial space between the two such containers and also for forming major panels of both such containers, (b) inner minor panel portions foldably attached to the ends of the central panel portion for forming side edge panels of said containers, (c) outer major panel portions foldably attached to the outer edges of said inner minor panel portions for forming the other major panels of said containers, (d) outer minor panel portions foldably attached to the outer edges of said outer major panel portions for forming other side edge panels of said containers, (e) glue tabs foldably attached to the outer edges of said outer minor panel portions, (f) end panel portions foldably attached to at least some of said panel portions to provide end panels for said containers, and (g) said blank having at least one tear-away portion integrally formed in at least one of said panel portions providing easy access to the contents of each of said containers.

2. A container blank as set forth in claim 1 in which said central panel portion has a tear strip across its center to provide easy separation of the two containers formed from the blank.

3. A container blank as set forth in claim 1 in which said tear-away portion is integrally formed in said central panel portion.

4. A container blank as set forth in claim 1 in which said tear-away portion is integrally formed in a said outer major panel portion.

5. A container blank as set forth in claim 1 in which said tear-away portion is integrally formed in a said end panel portion.

6. A container blank as set forth in claim 1 in which said central panel portion has at least one of said end panel portions foldably attached to it and said end panel portion has a said tear-away portion.

7. A container blank as set forth in claim 1 in which said tear-away portion is an integral substantial area of at least one said panel portion and is pre-formed by reverse cut construction to facilitate ripping it apart from said panel portion.

8. A container blank as set forth in claim 7 which has two said tear-away portions which are substantial areas of said relatively large central panel portion.

9. A container blank as set forth in claim 7 which has two said tear-away portions which are substantial areas of said outer major panel portions.

10. A pair of containers with a bridge across a substantial space between them formed from the blank of claim 1.

* * * * *